US005541009A

United States Patent [19]

Hieke et al.

[11] Patent Number: 5,541,009

[45] Date of Patent: Jul. 30, 1996

[54] PROCESS FOR PREPARING WATER-BASED PYROTECHNIC ACTIVE COMPOSITIONS CONTAINING METAL POWDER, COATED METAL POWDERS AND USE THEREOF

[75] Inventors: Klaus Hieke, Neuenburg; Angelika Frehn, Auggen, both of Germany

[73] Assignee: Buck Werke GmbH & Co., Bad Oberkingen, Germany

[21] Appl. No.: 513,683

[22] Filed: Jul. 27, 1995

Related U.S. Application Data

[63] Continuation of Ser. No. 206,730, Mar. 7, 1994, abandoned.

[30] Foreign Application Priority Data

Mar. 8, 1993 [DE] Germany ..... 43 07 237.2

[51] Int. Cl.[6] ..... B05D 7/00

[52] U.S. Cl. ..... 427/213; 427/220; 427/245

[58] Field of Search ..... 427/213, 220, 427/295

[56] References Cited

U.S. PATENT DOCUMENTS

| | | | |
|---|---|---|---|
| 3,706,611 | 12/1972 | Hastings | 149/44 |
| 3,903,219 | 9/1975 | Stephanoff | 149/72 |
| 4,092,383 | 5/1978 | Reed, Jr. | 149/92 |
| 4,434,009 | 2/1984 | Banba | 106/290 |
| 4,624,186 | 11/1986 | Widero | 102/336 |
| 4,663,262 | 5/1987 | Oka et al. | 430/108 |
| 4,770,728 | 9/1988 | Berg et al. | 149/11 |
| 4,810,524 | 3/1989 | Nakayama et al. | 427/213 |
| 4,828,882 | 5/1989 | Tsezos et al. | 427/213 |
| 4,853,052 | 8/1989 | Calsson et al. | 149/109.6 |
| 4,981,535 | 1/1991 | Hadermann et al. | 149/19.92 |

FOREIGN PATENT DOCUMENTS

| | | | |
|---|---|---|---|
| 236729 | 11/1964 | Austria . | |
| 240128 | 5/1965 | Austria . | |
| 0188171 | 7/1986 | European Pat. Off. | G03G 9/10 |
| 0310580 | 4/1989 | European Pat. Off. | C06C 5/06 |
| 1180530 | 12/1958 | France . | |
| 2238692 | 2/1975 | France | C06B 33/14 |
| 1234195 | 2/1967 | Germany | C06B 45/32 |
| 1938933 | 2/1970 | Germany | C05G 3/00 |
| 3626861 | 11/1988 | Germany | C06B 21/00 |
| 1025694 | 4/1966 | United Kingdom . | |
| 1271964 | 4/1972 | United Kingdom | B05L 3/00 |
| 1414617 | 11/1975 | United Kingdom | C06B 33/00 |

OTHER PUBLICATIONS

Swaraj Paul, *Surface Coatings: Science and Technology*, Chichester: John Wiley & Sons (1985), pp. 290–297.

*Primary Examiner*—Benjamin Utech
*Attorney, Agent, or Firm*—Darby & Darby, P.C.

[57] ABSTRACT

A process for preparing water-based pyrotechnic active compositions containing metal powder is described, which comprises coating the metal powder with a plastic which is insoluble in dilute acids and water and is substantially impermeable to water and oxygen, the coating being present in a quantity of not more than 5 per cent by weight, relative to the total mass of the metal powder, and suspending the powder obtained in water, mixing it with the other constituents of the active composition and bringing it to the desired shape, the coating of the metal powder preferably being carried out by the fluidized-bed process.

6 Claims, 1 Drawing Sheet

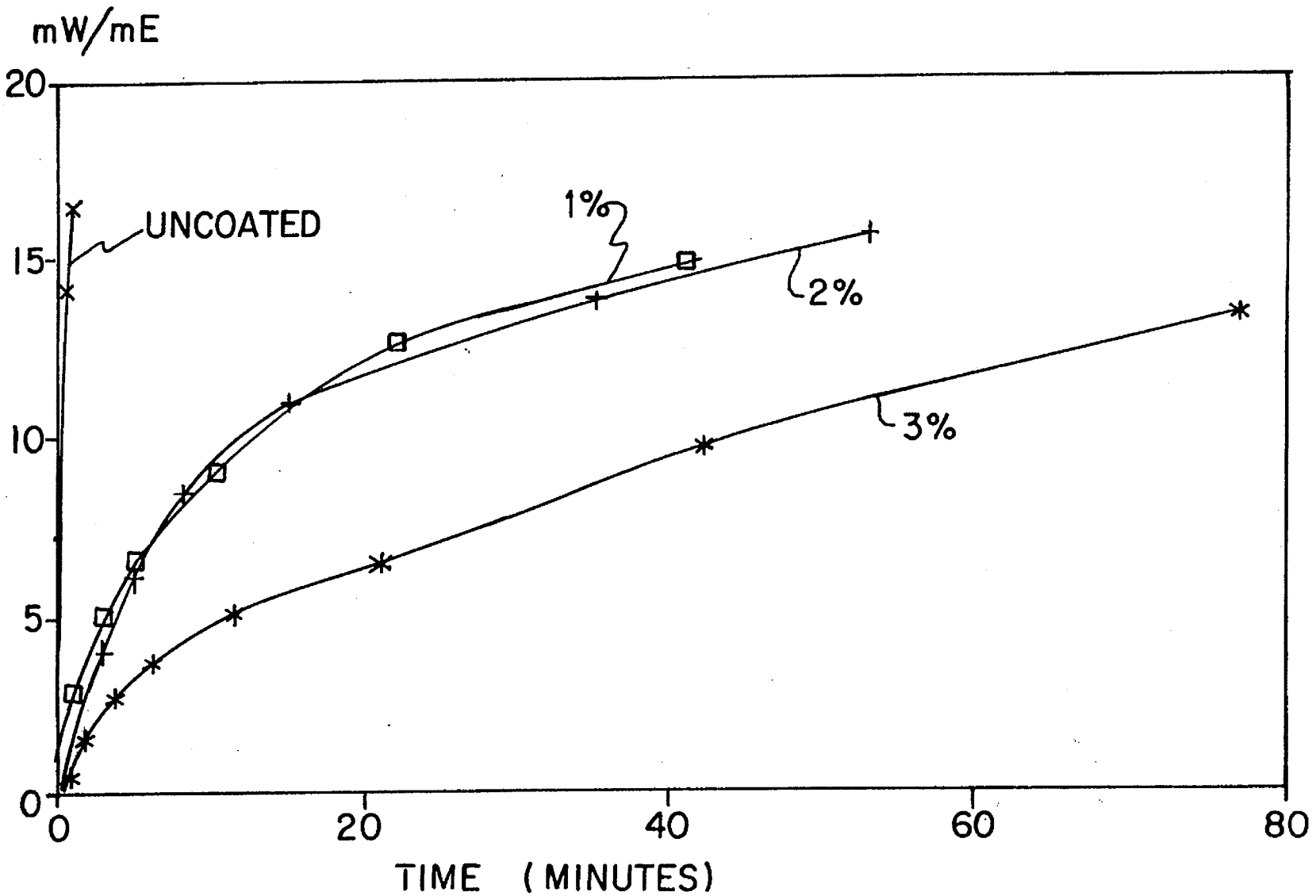
mW/mE
20
15
10
5
0
UNCOATED
1%
2%
3%
0
20
40
60
80
TIME (MINUTES)

PROCESS FOR PREPARING WATER-BASED PYROTECHNIC ACTIVE COMPOSITIONS CONTAINING METAL POWDER, COATED METAL POWDERS AND USE THEREOF

This is a continuation of application Ser. No. 08/206,730, filed Mar. 7, 1994, now abandoned.

BACKGROUND OF THE INVENTION

The invention relates to a process for preparing water-based pyrotechnic active compositions containing metal powder, to coated metal powders and to the use thereof.

Protechnic active compositions frequently contain, as the active principle, red phosphors in combination with metal powder, in particular with aluminium or magnesia. Hitherto the preparation of such active compositions was carried out by dissolving a binder in a chlorinated hydrocarbon, suspending the magnesium powder or aluminium powder and the red phosphorus in this solution and granulating the suspension by evaporation of the solvent. These granules could then be readily further processed and metered. For reasons of protection of the environment, however, chlorinated hydrocarbons cause problems, and their use will be restricted in the course of the next few years, so that they must be replaced by other solvents. Processing in an aqueous system, which is the most easily handled with respect to safety, emission problems and toxicity problems, would of course be advantageous. Metal powders cannot, however, be readily suspended in water, since this might lead to an explosive reaction with the formation of hydrogen and hydroxides. Moreover, they are partially inactivated by the formation of hydroxides. The metal powder, such as magnesium powder or aluminium powder, must therefore be pretreated in such a way that it cannot react with water.

It is already known to modify metal powders by chemical oxidation or physical processes in such a way that no harmful reactions occur on contact with water. Thus, for example AT-B 236,729 and AT-B 240,128 have disclosed processes for chemically oxidizing aluminium powder and magnesium powder, wherein the granules forming the powder are coated with an oxide skin which protects the metal. It is also known to provide metal powders with a coating, for example of stearic acid. A disadvantage of these processes is, however, that either no adequate protection against water is obtained or that the reactivity is diminished to such an extent that the metal powders can no longer satisfactorily undergo the desired reaction, or not at all.

From DE-A 3,626,861, a process was known for preparing propellant powder, which is safe to handle and is based on crystalline explosives, wherein the individual crystals of the explosive were enveloped by a resin in a fluidized-bed process. Moreover, U.S. Pat. No. 3,706,611 has disclosed a process for preparing a pyrotechnic plastic composition which consists of a liquid polysulphide polymer, a rubber-forming agent, a metal powder, an organic oxidizing agent and a dye, the metal powder and the liquid polymer being first mixed at very low pressure and the oxidizing agent and dyes then being added gradually.

BRIEF DESCRIPTION OF THE INVENTION

The object of the invention is now the provision of a process for preparing pyrotechnic active compositions which, as the active principle, contain, for example, red phosphorus in combination with metal powder in addition to other conventional ingredients, wherein the active composition can be processed in an aqueous system without the metal powder, which forms a part of the active composition, being inactivated or being able to trigger an explosive reaction.

This object is achieved by a process for preparing water-based pyrotechnic active compositions containing metal powder, which is characterized in that the metal powder is coated with a plastic which is insoluble in dilute acids and water and is substantially impermeable to water and oxygen, the coating being present in a quantity of not more than 5 per cent by weight, relative to the total mass of the metal powder, and the powder obtained is suspended in water, mixed with the other constituents of the active composition and brought to the desired shape.

BRIEF DESCRIPTION OF THE FIGURE

The Figure is a diagram showing the hydrogen evolution resulting from treating magnesium powder uncoated and coated with various weights of plastic upon treatment with 0.1N hydrochloric acid.

Surprisingly, it has been found that, by coating metal powders with a very thin layer of a plastic which is insoluble in water and dilute acids and is substantially impermeable to water and oxygen, the metal powder can be inactivated to such an extent that it does not undergo the undesired reactions during storage, processing in aqueous suspension and preparation of the pyrotechnic active compositions, but this coating having no disadvantageous effect on the properties, in particular the reactivity, of the pyrotechnic active composition itself.

DETAILED DESCRIPTION OF THE INVENTION

The essential point of the process according to the invention is the treatment of the metal powder. According to the invention, the metal powder is provided with a coating of a plastic which is insoluble in dilute acids and water and is substantially impermeable to water and oxygen. Such plastics are known to those skilled in the art, and all plastics which have these properties and do not adversely affect the active composition, are suitable for this purpose. Preferably, polymers or copolymers based on acrylic acid, methacrylic acid, acrylate esters and/or methacrylate esters are used for the plastic coating. These polymers or copolymers are suitable for forming very thin coatings which nevertheless prevent reaction of the enveloped metal grain with water or acid. Particularly preferably, a methacrylic acid/methyl methacrylate copolymer is used. During coating of the metal powder, an agglomeration of the particles can occur, but this does not have a disadvantageous effect on the properties, since the agglomerates break apart again during the processing to give active compositions.

The coating on the metal particles must be very thin and must amount to not more than 5 per cent by weight, relative to the total mass of the metal powder. If the coating becomes unduly thick, the reaction of the particles in the active composition is impeded, which is undesired. Particularly good results are obtained with coatings which are applied in a quantity which corresponds to 1 to 4 per cent by weight, in particular 2.5 to 3.5 per cent by weight, relative to the total mass of the metal powder.

In order to be able to apply such thin coatings uniformly to the metal powder, a fluidized-bed process is used, such as is known per se. The fluidized-bed process must be carried out in such a way that moisture is excluded during the coating. Particularly preferably, the coating is carried out by means of a vacuum fluidized-bed process in a manner known to those skilled in the art. The process is suitable for all metal powders which are to be used for pyrotechnic active compositions and which are to be processed in aqueous systems. Preferably, the process is applied to aluminium powder and magnesium powder.

The metal powder coated with the plastic can be stored in this form and, for preparing the pyrotechnic active composition, is suspended in water, mixed with the other constituents known per se, for example red phosphorus, and then brought to the desired shape.

The stability of the coated metal powder during storage and during the suspension in water is excellent, and the reactivity of the active composition is not significantly impaired.

The invention also relates to a metal powder with a coating of a plastic which is insoluble in dilute acids and water and is substantially impermeable to water and oxygen, the coating amounting to not more than 5 per cent by weight, relative to the total mass of the metal powder.

The metal powder coated according to the invention can be stored and transported in this form. It is stabilized against an alteration by water or oxygen or acid and can therefore be used in diverse ways, in particular for processes in which aqueous suspensions of metal powder are used. Particularly preferably, the metal powder coated according to the invention is used for preparing water-based pyrotechnic active compositions.

The invention is explained by the examples which follow.

EXAMPLE 1

Magnesium powder was provided with a stabilizing coating. A magnesium powder having an average particle size of 90 to 140 μm was used. 9.0 kg of this magnesium powder were fluidized in a vacuum fluidized bed. A solution of 3.5% of 1:2 methacrylic acid/methyl methacrylate copolymer in acetone/methanol (12%:88%) was sprayed on. In doing this, the following process conditions were maintained:

| | |
|---|---|
| System pressure: | about 250 mbar |
| Gas inlet temperature: | about 90° C. |
| Spraying pressure: | about 40 bar |
| Spraying rate: | about 80 g/minute |
| Temperature of the spraying solution: | about 60° C. |
| Condensation temperature: | about −35° C. |

After spraying of 2.57 kg, 5.14 kg and 7.71 kg of solution, samples were taken without interrupting the process. This corresponded to an applied film of 1%, 2% and 3%.

Stability tests were carried out on these samples, 300 mg in each case of uncoated magnesium and magnesium coated with 1%, 2% and 3% being investigated. For this purpose, the sample material was transferred into a 500 ml two-necked flask which was standing up to the attached ground joint in a water bath thermostatically controlled at 25° C. The two-necked flask provided with a 100 ml dropping funnel was connected via a hose connection to a thermostatically controlled burette. The latter was in turn provided with a pressure balance vessel. Water was used as the barrier fluid in the burette and in the pressure balance vessel. Before the start of the measurement, the level in the burette was equalized. After the temperature had been equalized at 25° C. throughout the apparatus, 50.0 ml of a 0.1N hydrochloric acid were rapidly added from the dropping funnel to the sample previously introduced. The time-dependent evolution of hydrogen was then determined by simply reading off the water volume displaced in the burette. The result is given as the quotient $m_W/m_E$ of the hydrogen evolution $m_W$ ($D_{25}$=0.1 m/ml) and the quantity weighed $m_E$.

Under the conditions indicated, an agglomeration of particles took place, with the formation of stable secondary agglomerates. The average grain size was thereby increased from about 120 μm to about 310 μm. As a result, the flow properties of the coated magnesium powder were substantially improved. The samples were not screened for the evaluation.

In the case of the uncoated magnesium powder, the evolution of hydrogen was so vigorous, that the measuring capacity of the burette (50 ml) was exceeded in the first minute after addition of the 0.1N hydrochloric acid.

BRIEF DESCRIPTION OF THE DRAWING

The figure shows a diagram in which the results are plotted for the hydrogen evolution $m_W/m_E$ related to the quantity weighed for the magnesium powder coated with 1%, 2% and 3%, and for the uncoated magnesium powder. There are only slight differences in the hydrogen evolution for 1% and 2% of coating quantity; however, there is a significant delay as compared with the uncoated sample. A further improvement takes place with the sample provided with a coating of 3%.

We claim:

1. A process for preparing a pyrotechnic active composition comprising: coating metal powder in a vacuum fluidized bed with a plastic to form a uniform coating on said metal powder which is insoluble in water and soluble in an organic solvent and substantially impermeable to water and oxygen wherein moisture is excluded during the coating of the metal powder, said coating being not more than 3.5% by weight of the metal powder based on the total mass of the metal powder; suspending said coated metal powder and the active pyrotechnic constituent in water and thereafter shaping said suspension so as to form a water-based pyrotechnic active composition.

2. The process of claim 1 wherein the metal powder is aluminum or magnesium.

3. The process of claim 1 wherein the plastic is a polymer or copolymer of acrylic acid, methacrylic acid, acrylate esters, methacrylate esters, or a combination thereof.

4. The process of claim 1 wherein the plastic is a copolymer of methacrylic acid and methyl methacrylate dissolved in a solvent.

5. The process of claim 1 wherein the coating is at least 1% by weight of the metal powder based on the total mass of the metal powder.

6. The process of claim 1 wherein the coating is at least 2.5% by weight of the metal powder based on the total mass of the metal powder.

* * * * *